US011879483B2

(12) United States Patent
De Raeve et al.

(10) Patent No.: US 11,879,483 B2
(45) Date of Patent: Jan. 23, 2024

(54) MULTIPHASE PUMP

(71) Applicant: Sulzer Management AG, Winterthur (CH)

(72) Inventors: Karel De Raeve, Winterthur (CH); Bartosz Kus, Kalisz (PL); Thomas Welschinger, Radolfzell (DE)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 17/241,485

(22) Filed: Apr. 27, 2021

(65) Prior Publication Data

US 2021/0355965 A1 Nov. 18, 2021

(30) Foreign Application Priority Data

May 18, 2020 (EP) ..... 20175212

(51) Int. Cl.
*F04D 29/66* (2006.01)
*F04D 3/00* (2006.01)
(Continued)

(52) U.S. Cl.
CPC ..... *F04D 29/669* (2013.01); *F04D 3/00* (2013.01); *F04D 29/086* (2013.01);
(Continued)

(58) Field of Classification Search
CPC ..... F04D 29/669; F04D 3/00; F04D 29/086; F04D 29/528; F04D 29/548; F04D 29/66; F04D 29/661; F04D 29/667
See application file for complete search history.

(56) References Cited

U.S. PATENT DOCUMENTS 9,234,529 B2 1/2016 Meuter et al.
11,136,897 B2 * 10/2021 Tsukuda ..... F01D 11/005
(Continued)

FOREIGN PATENT DOCUMENTS

EP 2386766 A2 11/2011

OTHER PUBLICATIONS

Extended European Search Report dated Oct. 26, 2020 in corresponding European Patent Application No. 20175212.8, filed May 18, 2020.

*Primary Examiner* — Eldon T Brockman
*Assistant Examiner* — Andrew J Marien
(74) *Attorney, Agent, or Firm* — GLOBAL IP COUNSELORS, LLP

(57) ABSTRACT

A multiphase pump for conveying a multiphase process fluid includes a pump housing, a stationary diffuser, a rotor and swirl brake. The rotor is arranged in the pump housing and is rotatable about an axial direction, the rotor including a pump shaft and an impeller fixedly mounted on the pump shaft. The stationary diffuser is arranged adjacent to and downstream of the impeller. The impeller includes a blade with the blade having a radially outer tip, and a ring surrounding the impeller and arranged at the radially outer tip of the blade. A passage is between the ring and a stationary part configured to be stationary with respect to the pump housing, the passage extending in the axial direction from an entrance to a discharge. The swirl brake is disposed at the passage, and configured and arranged to brake swirling of the process fluid passing through the passage.

20 Claims, 8 Drawing Sheets

(51) Int. Cl.

| | |
|---|---|
| ***F04D 29/08*** | (2006.01) |
| ***F04D 29/52*** | (2006.01) |
| ***F04D 29/54*** | (2006.01) |

(52) U.S. Cl.
CPC ..... *F04D 29/528* (2013.01); *F04D 29/548* (2013.01); *F04D 29/66* (2013.01); *F04D 29/661* (2013.01); *F04D 29/667* (2013.01)

(56) References Cited

U.S. PATENT DOCUMENTS

| | | | | |
|---|---|---|---|---|
| 2012/0093636 | A1* | 4/2012 | Homstvedt | F04D 1/025 415/207 |
| 2012/0183388 | A1* | 7/2012 | Vannini | F16J 15/4472 415/111 |
| 2013/0341033 | A1* | 12/2013 | Carstensen | H02K 5/132 166/372 |
| 2016/0281726 | A1* | 9/2016 | Klepsvik | F04D 29/0416 |
| 2017/0175752 | A1* | 6/2017 | Hofer | F04D 3/02 |
| 2018/0100514 | A1* | 4/2018 | Venkataraman | F04D 29/00 |
| 2018/0223854 | A1* | 8/2018 | Brunvold | F04D 13/0646 |
| 2019/0277302 | A1* | 9/2019 | Klepsvik | F04D 29/183 |
| 2020/0088201 | A1* | 3/2020 | Bourne | F04D 15/0011 |
| 2020/0158135 | A1* | 5/2020 | Bourne | F04D 29/628 |

* cited by examiner

MULTIPHASE PUMP

CROSS-REFERENCE TO RELATED APPLICATION

This application claims priority to European Patent Application No. 20175212.8, filed May 18, 2020, the contents of which are hereby incorporated herein by reference in their entirety.

BACKGROUND

Field of the Invention

The invention relates to a multiphase pump for conveying a multiphase process fluid.

Background Information

Conventional multiphase pumps can be used in many different industries, where it is necessary to convey a multiphase process fluid which comprises a mixture of a plurality of phases, for example a liquid phase and a gaseous phase. An important example is the oil and gas processing industry where multiphase pumps are used for conveying hydrocarbon fluids, for example for extracting the crude oil from the oil field or for transportation of the oil/gas through pipelines or within refineries.

Fossil fuels are usually not present in pure form in oil fields or gas fields, but as a multiphase mixture which contains liquid components, gas components and possibly also solid components. This multiphase mixture of e.g. crude oil, natural gas, chemicals, seawater and sand has to be pumped from the oil field or gas field. For such a conveying of fossil fuels, multiphase pumps are used which are able to pump a liquid-gas mixture which may also contain solid components, sand for example.

SUMMARY

It has been found that one of the challenges regarding the design of multiphase pumps is the fact that in many applications the composition of the multiphase process fluid strongly varies during operation of the pump. For example, during exploitation of an oil field the ratio of the gaseous phase (e.g. natural gas) and the liquid phase (e.g. crude oil) strongly varies. These variations can occur very suddenly and could cause a drop in pump efficiency, vibrations of the pump or other problems. The ratio of the gaseous phase in the multiphase mixture is commonly measured by the dimensionless gas volume fraction (GVF) designating the volume ratio of the gas in the multiphase process fluid. In applications in the oil and gas industry the GVF may vary from 0% to 100%.

In view of an efficient exploitation of oil and gas fields it has been found that there is an increasing demand for pumps that can be installed directly on the sea ground in particular down to a depth of 500 m, down to 1000 m or even down to more than 2000 m beneath the water's surface. Needless to say, that the design of such pumps is challenging, in particular because these pumps shall operate in a difficult subsea environment for a long time period with as little as possible maintenance and service work. This requires specific measurements to minimize the amount of equipment involved and to optimize the reliability of the pump.

It is well-known in the art, that multiphase pumps are prone to rotor vibrations. The rotor of the pump comprises the pump shaft and the impeller(s) fixed to the pump shaft in a torque proof manner. There are several reasons why rotor vibrations are an issue particularly in multiphase pumps. A conventional single phase centrifugal pump has a significant amount of internal damping due to the leakage of the single phase process fluid through the internal seals or gaps along the rotor of the pump. Examples for such seals or gaps are the impeller eye seal, the impeller hub seal, wear rings, throttle bushings and the balance drum. The leakage flow of the process fluid through these seals or gaps counteracts vibrations and generates rotor damping. The physical phenomenon, on which this damping is based, is the Lomakin effect. The Lomakin effect is a force created at small gaps, e.g. at wear rings, throttling bushes or balancing devices in centrifugal pumps. The force is a result of an unequal pressure distribution around the circumference of the pump shaft during periods of rotor eccentricity or pump shaft deflection. Due to the eccentricity of the rotor the clearance, i.e. the gap between the rotor and the stationary part surrounding the rotor, is larger at one side of the rotor than on the other side of the rotor. This results in differences in the local velocity of the fluid. The local velocity of the fluid is higher at those locations where the clearance is larger. A higher local velocity causes a lower pressure, and a lower local velocity causes a higher pressure. This creates a net corrective force, which always acts in the direction opposite to the shaft deflection or eccentricity. Thus, the Lomakin effect supports the centering of the pump shaft and therewith generates a damping of the rotor.

A multiphase pump can be designed for conveying multiphase process fluids having a GVF from 0% to 100%, i.e. all process fluids from a pure liquid (GVF=0%) to a pure gas (GVF=100%). At high GVF values the pressure rise generated by the multiphase pump is significantly smaller than at low GVF values. A multiphase pump, which is for example configured with helico-axial impellers, typically has only the balance drum and the diffuser gaps as clearances. These clearances are designed to allow the leakage of a liquid and are thus considerably large for applications or operating conditions with high GVFs. Thus, the problem regarding multiphase pumps is that for operating conditions in particular with high GVF values there is only a very small damping of the rotor generated by the Lomakin effect, because the multiphase pump has only a few gaps or clearances along the pump shaft and these gaps and clearances are quite large for a process fluid having a high gas content or being close to a pure gaseous process fluid. In addition, as already said, at high GVF values the pressure rise generated by the pump decreases considerably. Therefore, the pressure drop over the clearances and gaps is significantly reduced, so that the stabilizing force generated by the Lomakin effect decreases remarkably.

To address this problem of rotor vibrations caused for example by high hydraulic excitations inside a multiphase pump it has been proposed in U.S. Pat. No. 9,234,529 to provide a hydrodynamic stabilization device for the rotor. The device is configured as a process fluid lubricated Lomakin damper, i.e. a damper that works on the basis of the Lomakin effect. The damper comprises a cover ring extending along the radially outer tips of the blades of a helico-axial impeller. The cover ring is fixed to the blades of the impeller. This design is also referred to as shrouded impeller. Thus, a gap is formed between the rotating cover ring and the stationary part of the pump housing surrounding the cover ring. A shrouded impeller can be fully shrouded or partially shrouded. A fully shrouded impeller has a cover ring that fully covers the blades of the impeller. A partially shrouded impeller has a cover ring that covers just a section of the impeller (with respect to the axial direction). The most effective design is a fully shrouded impeller, since it allows to maintain two-phase flow disturbance within the impeller flow channel without generating varying radial forces on the rotor, which is the case for an open impeller.

Since the local pressure at the high pressure side or discharge side of an individual impeller is higher than the local pressure at the low pressure side or suction side of the impeller, a part of the process fluid is recirculated from the high pressure side through the gap to the low pressure side. In particular for a high pressure difference across the gap, this fluid generates a hydrodynamic stabilization layer which generates damping of the rotor based on the Lomakin effect. The force resulting from the Lomakin effect is directed such that it centers the pump shaft and therewith dampens the vibrations of the rotor. But especially for a small pressure difference across the gap, the hydrodynamic forces can become destabilizing. In the extreme case of a zero pressure difference across the gap, the destabilizing hydrodynamic flow pattern in the gap is known as the Taylor-Couette flow.

For a high pressure difference across the gap, the rotordynamic coefficients which quantify the hydrodynamic behavior of the fluid in the gap have direct rotordynamic coefficients which are significantly bigger then the indirect rotordynamic coefficients. For small pressure differences, the indirect rotordynamic coefficients tend to become as big or bigger as the direct rotordynamic coefficients. These indirect rotordynamic coefficients represent the destabilizing hydrodynamic fluid effects.

This hydrodynamic stabilization device proposed in U.S. Pat. No. 9,234,529 has proven to be very effective in practice, in particular for given operating conditions, such as low GVF operating conditions, however there is still room for improvement. It has been noticed that regarding the rotor damping in a multiphase pump the gap between the cover ring and the stationary part of the pump housing can have a significant negative impact on the rotor dynamics when there are small pressure differences over the gap, like in the case of high GVF operation conditions. These destabilizing effects increase when the clearance is further reduced, i.e. the width of the gap. This destabilizing behavior occurs in the case of high GVF operating conditions and for certain regions of the operating envelope of the pump, which results in small pressure differences across the gaps. However, enlarging the clearance reduces the efficiency of the pump.

Thus, there is a conflict between reducing the hydraulic efficiency too much by enlarging the width of the gap and reducing the rotordynamic stability too much by narrowing the width of the gap, so that vibration acceptance criteria might be exceeded in particular for the aforementioned operating conditions.

Accordingly, there is a need for a solution which allows both, namely a design, which on the one hand results in a small leakage flow over the cover ring and which on the other hand does not deteriorate the rotordynamic stability of the pump, in particular in certain regions of the operating envelope. The ideal design has a rotordynamic stabilizing effect for the whole operating range and not just for a fraction of the operating range. The whole operating range goes from low to high GVF values and covers the whole operating envelope going from low to high speed and part load to over load.

It is therefore an object of the invention to propose a multiphase pump with an improved damping of the rotor, so that the rotor vibrations are considerably reduced without significantly reducing the hydraulic efficiency of the multiphase pump.

The subject matter of the invention satisfying this object is characterized by the features disclosed herein.

Thus, according to an embodiment of the invention, a multiphase pump for conveying a multiphase process fluid is proposed, comprising a pump housing, a rotor arranged in the pump housing and configured for rotating about an axial direction, wherein the rotor comprises a pump shaft and at least one impeller fixedly mounted on the pump shaft, wherein a stationary diffuser is arranged adjacent to and downstream of the impeller, wherein the impeller comprises at least one blade with each blade having a radially outer tip, and wherein the impeller comprises a ring surrounding the impeller and arranged at the radially outer tip of the blade, wherein a passage is disposed between the ring and a stationary part configured to be stationary with respect to the pump housing, said passage extending in the axial direction from an entrance to a discharge, wherein at least one swirl brake is provided at the passage, and wherein the swirl brake is configured and arranged to brake a swirl of the process fluid passing through the passage.

It has been found that the process fluid which flows in the passage between the stationary part and the rotating ring surrounding the impeller starts to swirl more and more due to entrainment by the rotating impeller. This has a negative impact on the rotor dynamics. In particular for a small pressure difference over the passage the flow through the passage between the stationary part and the rotating impeller even tends to become destabilizing due to the development of a strong swirl in the passage. The impeller with the ring is particularly sensitive to this swirl.

Thus, according to embodiments of the invention, the swirl in the passage will be limited by providing at least one swirl brake to brake the swirl of the process fluid passing through the passage. This can be achieved by reducing the inlet swirl, i.e. the swirl existing at the entrance of the passage, or by reducing the swirl build-up in the passage. Of course, it is also possible to reduce both the inlet swirl and the swirl build-up in the passage.

The fluid flowing into the passage has a high initial swirl, since it is the fluid which leaves the rotating impeller that is deviated into the passage. The inlet swirl at the passage is thus roughly equivalent to the swirl of the fluid at the outlet of the impeller.

The inlet swirl can be reduced by installing swirl brakes at the inlet of the gap and the swirl build-up in the gap can be stopped by installing grooves with swirl brakes along the length of the gap. By providing at least one swirl brake at the passage, the clearance of the passage, i.e. the width of the passage in the radial direction, can be reduced significantly without impacting the rotordynamic stability of the pump. Decreasing the width of the passage in the radial direction reduces the flow through the passage and therewith increases the hydraulic efficiency of the multiphase pump.

According to a first embodiment of the invention the swirl brake is arranged at the entrance of the passage. Thus, the inlet swirl, which is the swirl of the process fluid already existing at the entrance of the passage, may be considerably reduce.

In such embodiments where the swirl brake is arranged at the entrance of the passage, it is possible that the swirl brake is arranged at the diffuser. It is, of course also possible that the swirl brake is arranged at the stationary part.

According to a second embodiment of the invention, the stationary part comprises a radially inner surface delimiting the passage with respect to a radial direction being perpendicular to the axial direction, wherein the radially inner surface includes a groove surrounding the pump shaft in a circumferential direction, and wherein the swirl brake is arranged in the groove. Preferably, the swirl brake extends over the entire length of the groove. With the swirl brake arrange in the groove it is in particular possible to considerably reduce the swirl build-up in the passage.

According to a third embodiment of the invention a plurality of swirl brakes is provided, namely a first swirl brake arranged at the entrance of the passage, and at least one second swirl brake, which is arranged in a groove surrounding the pump shaft in a circumferential direction, wherein the groove is disposed in a radially inner surface of the stationary part, delimiting the passage with respect to a radial direction being perpendicular to the axial direction provided. The third embodiment comprising the first swirl brake and at least one second swirl brake has the advantage, that both the inlet swirl at the entrance of the passage and the swirl build-up in the passage may be considerably reduced.

In the third embodiment the first swirl brake is preferably arranged at the diffusor or at the stationary part.

In a variant of the third embodiment, a plurality of second swirl brakes is provided, each of which is arranged in a different groove.

According to a fourth embodiment of the invention, the ring surrounding the impeller comprises a protrusion extending along the circumference of the ring, wherein the protrusion is configured to deflect the process fluid at least partially into the swirlbrake in the groove. Since the protrusion deflects at least a part of the flow through the passage into the groove(s) with the swirl brake(s), the efficiency of the swirl brakes is enhanced.

As a preferred measure the protrusion is aligned with the groove with respect to the axial direction. Thus, the protrusion is completely surrounded or covered by the groove. It is also possible that the protrusion extends into the groove with respect to the radial direction.

According to a further variant, which can be combined with all embodiments, the ring is configured to form a labyrinth seal between the impeller and the stationary part.

Furthermore, it is a preferred design, that the multiphase pump comprises a plurality of stages, wherein each stage comprises an impeller and a diffuser, wherein at least one of the impellers comprises the ring surrounding the impeller, and wherein the swirl brake is provided at the passage, delimited by the ring. Thus, for those embodiments, where the multiphase pump is designed as a multistage pump it is not necessary, but of course possible, that all impellers are configured as shrouded impellers with the ring surrounding the impeller(s). In some embodiments only one of the impellers includes the ring, in other embodiments all impellers are surrounded by a respective ring and in still other embodiments more than one but less than all impellers are surrounded by a respective ring. Preferably, for each impeller, includes the ring surrounding the impeller, at least one swirl brake is disposed at the passage delimited by the respective ring.

As a further particularly preferred measure, which applies to all embodiments, the multiphase pump is configured as a helico-axial pump with helico-axial impellers.

The multiphase pump according to embodiments of the invention can further comprise a drive unit arranged in the pump housing and configured for driving the rotor, wherein the multiphase pump is preferably configured as a vertical pump with the pump shaft extending in the direction of gravity.

In other configurations the multiphase pump according to embodiments of the invention can be configured as a horizontal pump with the pump shaft extending perpendicularly to the direction of gravity. Such embodiments as horizontal pumps can be used for example at topside locations on an offshore platform or on a floating production storage and offloading unit (FPSO) or ashore.

In particular, the multiphase pump in accordance with the invention can be configured as a subsea pump and preferably configured for installation on a sea ground.

In view of another preferred application the multiphase pump according to embodiments of the invention can be configured as a helico-axial multistage horizontal pump with an external drive unit, i.e. the drive unit is not arranged within the pump housing.

In addition, it is particularly preferred, that the multiphase pump according to an embodiment of the invention is configured for conveying multiphase process fluids having a gas volume fraction of 0% to 100%, i.e. the multiphase fluid is configured in such a manner that it can be operated at all GVF values from 0% (pure liquid) to 100% (pure gas).

Further advantageous measures and embodiments of the invention will become apparent from this disclosure.

BRIEF DESCRIPTION OF THE DRAWINGS

The invention will be explained in more detail hereinafter with reference to the drawings.

DETAILED DESCRIPTION

Figure 1:
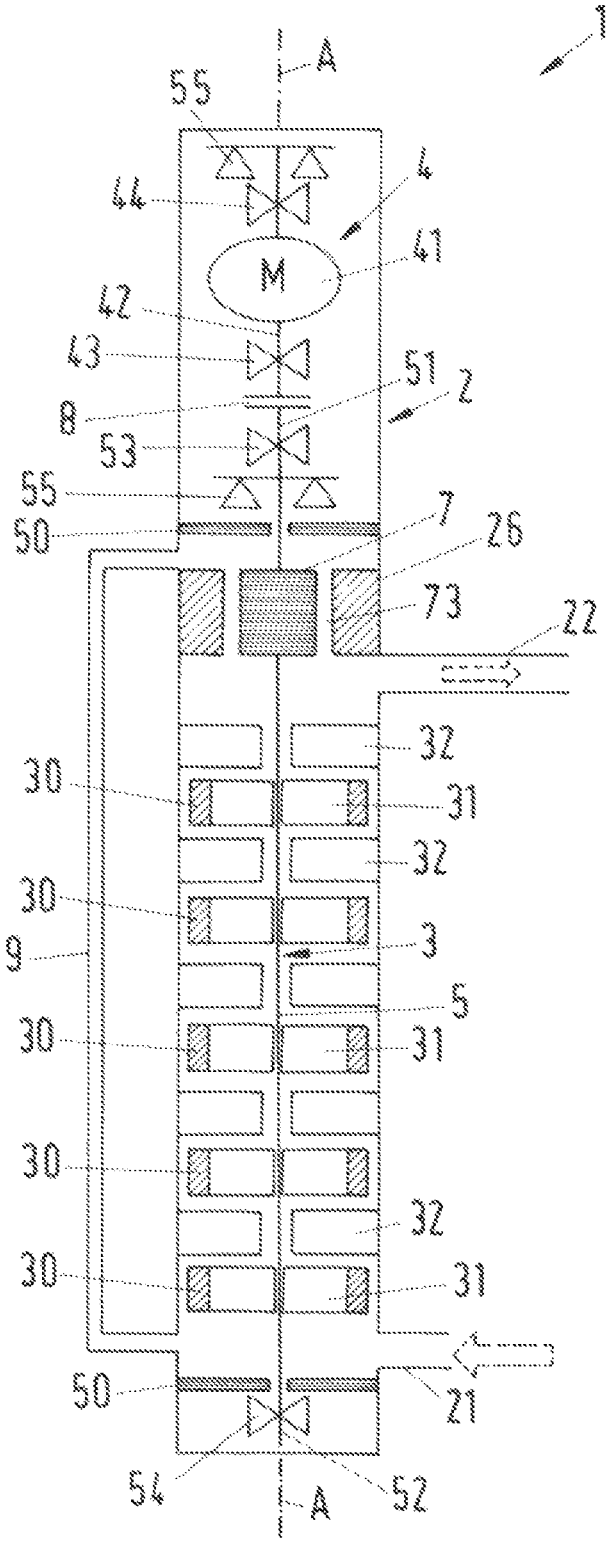
FIG. 1 is a schematic cross-sectional view of a first embodiment of a multiphase pump according to the invention.

FIG. 1 shows a schematic cross-sectional view of a first embodiment of a multiphase pump according to the invention, which is designated in its entity with reference numeral 1. The pump 1 is designed as a centrifugal pump for conveying a multiphase process fluid. The pump 1 has a pump housing 2, in which a rotor 3 is arranged. The rotor 3 is configured for rotating about an axial direction A. For rotating the rotor 3 a drive unit 4 is provided. In the embodiment shown in FIG. 1 the drive unit 4 is also arranged inside the pump housing 2. It goes without saying that in other embodiments of the multiphase pump the drive unit is arranged outside the pump housing 2, e.g. in a separate motor housing.

In the first embodiment shown in FIG. 1 both the rotor 3 and the drive unit 4 are arranged within the pump housing 2. The pump housing 2 is designed as a pressure housing, which is configured to withstand the pressure generated by the multiphase pump 1 as well as the pressure exerted on the pump 1 by the environment. The pump housing 2 can comprise several housing parts, which are connected to each other to form the pump housing 2 surrounding the rotor 3 and the drive unit 4. It is also possible that a rotor housing and a separate motor housing are both inserted in the pump housing 2. In the embodiment shown in FIG. 1 the pump housing 2 is configured as a hermetically sealed pressure housing preventing any leakage to the external environment.

In the following description reference is made by way of example to the important application that the multiphase pump 1 is designed and adapted for being used as a subsea multiphase pump 1 in the oil and gas industry. In particular, the multiphase pump 1 is configured for installation on the sea ground, i.e. for use beneath the water-surface, in particular down to a depth of 500 m, down to 1000 m or even down to more than 2000 m beneath the water-surface of the sea. In such applications the multiphase process fluid is typically a mixture containing hydrocarbons that has to be pumped from an oilfield for example to a processing unit beneath or on the water-surface or ashore. The multiphase mixture constituting the multiphase process fluid to be conveyed can include a liquid phase, a gaseous phase and a solid phase, wherein the liquid phase can include crude oil, seawater and chemicals, the gas phase can include methane, natural gas or the like and the solid phase can include sand, sludge and smaller stones without the multiphase pump 1 being damaged on the pumping of the multiphase mixture.

It has to be understood that the invention is not restricted to this specific example but is related to multiphase pumps in general. The multiphase pump 1 can also be configured for top side applications, e.g. for an installation ashore or on an oil platform, in particular on an unmanned platform. In addition, the pump 1 according to embodiments of the invention can also be used for applications outside the oil and gas industry.

The pump housing 2 of the multiphase pump 1 comprises a pump inlet 21, through which the multiphase process fluid enters the pump 1, and a pump outlet 22 for discharging the process fluid with an increased pressure as compared to the pressure of the process fluid at the pump inlet 21. Typically, the pump outlet 22 is connected to a pipe (not shown) for delivering the pressurized process fluid to another location. The pressure of the process fluid at the pump outlet 22 is referred to as 'high pressure' whereas the pressure of the process fluid at the pump inlet 21 is referred to as 'low pressure'. A typical value for the difference between the high pressure and the low pressure is for example 100 to 200 bar (10-20 MPa), in particular for low GVF conditions.

The rotor 3 of the multiphase pump 1 comprises a pump shaft 5 extending from a drive end 51 to a non-drive end 52 of the pump shaft 5. The pump shaft 5 is configured for rotating about the axial direction A, which is defined by the longitudinal axis of the pump shaft 5.

The rotor 3 further comprises at least one impeller 31 fixedly mounted on the pump shaft 5 in a torque proof manner. In the embodiment shown in FIG. 1 a plurality of impellers 31, namely five impellers 31 are arranged in series on the pump shaft 5, i.e. the multiphase pump 1 is configured as a five stage pump. Of course, the number of five stages is only exemplary. In other embodiments the multiphase pump 1 can comprise more than five stages, e.g. ten or twelve stages, or less than five stages for example four or two stages or only a single stage with only one impeller 31.

The plurality of impellers 31 is arranged in series and configured for increasing the pressure of the fluid from the low pressure to the high pressure.

The drive unit 4 is configured to exert a torque on the drive end 51 of the pump shaft 5 for driving the rotation of the pump shaft 5 and the impellers 31 about the axial direction A.

The multiphase pump 1 is configured as a vertical pump 1, meaning that during operation the pump shaft 5 is extending in the vertical direction, which is the direction of gravity. Thus, the axial direction A coincides with the vertical direction.

In other embodiments (see FIG. 16) the multistage pump 1 can be configured as a horizontal pump, meaning that during operation the pump shaft 5 is extending horizontally, i.e. the axial direction A is perpendicular to the direction of gravity.

A direction perpendicular to the axial direction A is referred to as radial direction. The term 'axial' or 'axially' is used with the common meaning 'in axial direction' or 'with respect to the axial direction'. In an analogous manner the term 'radial' or 'radially' is used with the common meaning 'in radial direction' or 'with respect to the radial direction'. Hereinafter relative terms regarding the location like "above" or "below" or "upper" or "lower" or "top" or "bottom" refer to the usual operating position of the pump 1. FIG. 1 shows the multiphase pump 1 in the usual operating position.

Referring to this usual orientation during operation and as shown in FIG. 1 the drive unit 4 is located above the rotor 3. However, in other embodiments the rotor 3 can be located on top of the drive unit 4.

As can be seen in FIG. 1 the multiphase pump 1 is designed with an inline arrangement of all impellers 31. In an inline arrangement all impellers 31 are arranged such that the axial thrusts generated by the individual rotating impellers 31 are all directed in the same direction, namely downwards in the axial direction A in FIG. 1. The flow of the fluid from the pump inlet 21 (low pressure) towards the pump outlet 22 (high pressure) is always directed in the same direction, namely in upward direction, and does not change as e.g. in a back-to-back arrangement (see FIG. 16). Between the impellers 31 of adjacent stages there is in each case a stationary diffusor 32 for directing the flow of the process fluid discharged from a particular impeller 31 to the impeller 31 of the next stage. Thus, between two adjacent impellers 31—as viewed in the axial direction A—there is in each case arranged one diffusor 32, which is stationary with respect to the pump housing 2. Each stage of the multiphase pump 1 comprises one impeller 31 and one diffuser 32, wherein the diffuser 32 of the respective stage is arranged adjacent to the impeller 31 with respect to the axial direction A and downstream of the impeller 31 of the respective stage.

Figure 2:
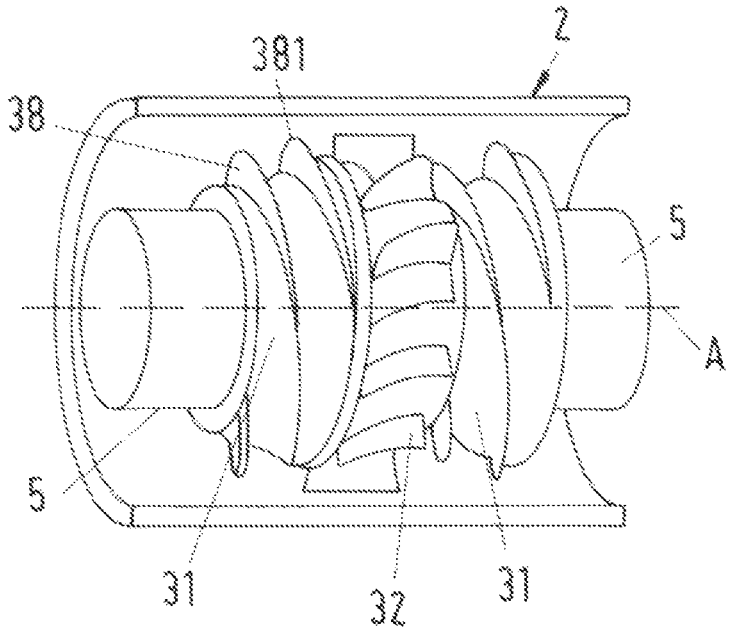
FIG. 2 is a perspective view of a helico-axial impeller (without ring)

According to a preferred design the multiphase pump 1 is configured as a helico-axial pump with helico-axial impellers 31. Helico-axial impellers 31 and helico-axial multiphase pumps 1 as such are known in the art. FIG. 2 shows a perspective view of two helico-axial impellers 31 with the diffusor 32 interposed between these two impellers 31. In FIG. 2 half of the pump housing 2 has been removed to render visible the helico-axial impellers 31. Furthermore, in FIG. 2 rings 30 surrounding the impellers 31 (see FIG. 3) are not shown for a better view on the impellers 31. A helico-axial impeller 31 has at least one blade 38 that extends helically around the hub of the impeller 31 or the pump shaft 5, respectively. In many embodiments each helico-axial impeller 31 comprises a plurality of blades 38, for example five blades 38, each of which extends helically around the pump shaft 5 or the hub of the impeller 31, respectively. Each blade 38 has a radially outer tip 381.

Figure 3:
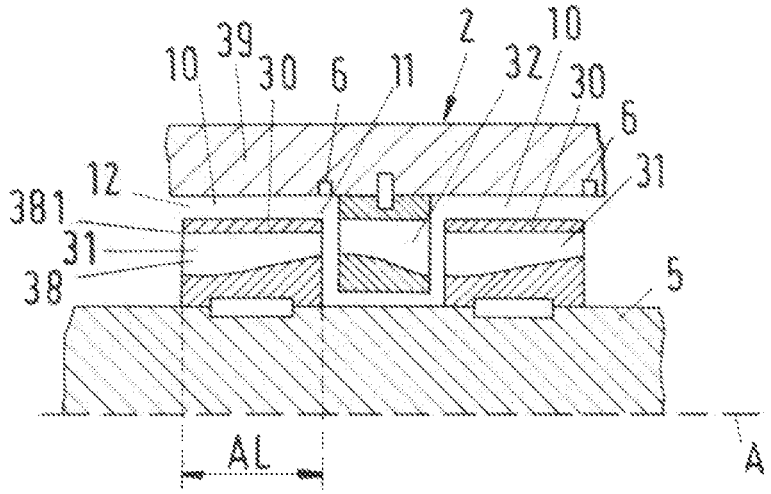
FIG. 3 is as FIG. 2 but in a cross-sectional view and with the ring.

In addition, FIG. 3 shows the two impellers 31 and the diffusor 32 between the two impellers 31 is a cross-sectional view with the cut line extending in axial direction A and through the pump shaft 5. As can be best seen in FIG. 3 the impellers 31 are fixed to the pump shaft 5 in a torque proof manner, e.g. by a key lock, and the diffusors 32 are fixed to the pump housing 2 or to a part that is stationary with respect to the pump housing 2. Furthermore, as illustrated in FIG. 3, each impeller comprises a ring 30 surrounding the respective impeller 31. The ring 30 is arranged at the radially outer tips 381 of the blades 38, so that the ring 30 forms the radially outer surface of the impeller 31. The ring 30 is fixed with respect to the outer tips 381, so that the ring 30 is connected to the impeller 31 in a torque proof manner. The design of the impeller 31 with the ring 30 disposed along the radially outer tips 381 of the blades 38 is also referred to as a "shrouded impeller" 31.

The ring 30 has an axial length AL, which is the extension of the ring 30 in the axial direction A. As it is shown for example in FIG. 3, the axial length AL of the ring 30 can at least approximately equal the extension of the impeller blades 38 in the axial direction A, so that the impeller blades 38 are completely covered by the ring 30. It has to be noted that in other embodiments the axial length AL of the ring 30 can be smaller than the extension of the impeller blades 38 in the axial direction A, so that the blades 38 are not completely covered by the ring 30 but protrude the ring 30 with respect to the axial direction A. The ring 30 can be designed as a wear ring 30.

The ring 30 is surrounded by a stationary part 39, so that a passage 10 is formed between the radially outer surface of the ring 30 and the stationary part 39. The stationary part 39 is configured to be stationary with respect to the pump housing 2. The passage 10 forms an annular gap between the radially outer surface of the ring 30 and the stationary part 39. The passage 10 extends in the axial direction A from an entrance 11 to a discharge 12. The entrance 11 is located at the discharge side of the impeller 31, where the higher pressure prevails, and the discharge 12 is located at the suction side of the impeller 31, where the lower pressure prevails during operation of the pump 1. Consequently, there is a leakage flow of the process fluid entering the passage 10 at the entrance 11, passing through the passage 10 and leaving the passage 10 at the discharge 12. This leakage flow is thus flowing in the opposite direction as the main flow of process fluid through the pump 1.

According to an embodiment of the invention at least one swirl brake 6 is disposed at the passage 10, wherein the swirl brake 6 is configured and arranged to brake a swirl or a pre-rotation of the process fluid passing through the passage 10. The swirl brake 6 can be arranged for braking the inlet swirl of the process fluid at the entrance 11 of the passage 10 or for braking the swirl build-up in the passage 10. As will be explained later on, in embodiments comprising more than one swirl brake 6 it is also possible to reduce both the inlet swirl at the entrance 11 of the passage 10 and the swirl build-up in the passage 10.

The at least one swirl brake 6 can be arranged at the entrance 11 of the passage 10 or in the stationary part 39 between the entrance 11 and the discharge 12 of the passage. If the at least one swirl brake 6 is arranged at the entrance 11 of the passage 10, the swirl brake 6 can be provided at the diffuser 32, more particularly at the axial end of the diffuser 32 facing the impeller 31, or the swirl brake 6 can be disposed at the stationary part 39. Different embodiments regarding the arrangement of the at least one swirl brake 6 will be explained below.

In other embodiments of the multiphase pump 1 the impellers 31 may not be configured as helico-axial impellers, but for example as semi-axial impellers.

For at least partially balancing the axial thrust generated by the impellers 31 during operation of the multiphase pump 1 it is preferred that the multiphase pump 1 comprises at least one balancing device. In the embodiment shown in FIG. 1 the balancing device comprises a balance drum 7 (also referred to as a throttle bush). The balance drum 7 is fixedly connected to the pump shaft 5 in a torque proof manner, i.e. the balance drum 7 is part of the rotor 3. The balance drum 7 is arranged behind—as seen in the flow direction of the process fluid—the diffuser 32 of the last stage that guides the process fluid to the pump outlet 22, namely between the diffuser 32 of the last stage and the drive end 51 of the pump shaft 5. The balance drum 7 defines a front side and a back side of the balance drum 7. The front side is the side facing the diffuser 32 of the last stage. The back side is the side facing the drive unit 4. The balance drum 7 is surrounded by a stationary balance part 26, so that a relief passage 73 is formed between the radially outer surface of the balance drum 7 and the stationary balance part 26. The stationary balance part 26 is configured to be stationary with respect to the pump housing 2. The relief passage 73 forms an annular gap between the outer surface of the balance drum 7 and the stationary balance part 26 and extends from the front side to the back side.

A balance line 9 is provided for recirculating the process fluid from the back side of the balance drum 7 to the low pressure side at the pump inlet 21. In particular, the balance line 9 connects the back side with the low pressure side of the multiphase pump 1, where the low pressure, i.e. the pressure at the pump inlet 21 prevails. Thus, a part of the pressurized fluid passes from the front side, where essentially the high pressure prevails, through the relief passage 73 to the back side, enters the balance line 9 and is recirculated to the low pressure side of the multiphase pump 1. The balance line 9 constitutes a flow connection between the back side of the balance drum 7 and the low pressure side at the pump inlet 21. The balance line 9 can be arranged—as shown in FIG. 1—outside the pump housing 2. In other embodiments the balance line 9 can be designed as internal line completely extending within the pump housing 2.

Due to the balance line 9 the pressure prevailing at the back side is essentially the same—apart from a minor pressure drop caused by the balance line 9—as the low pressure prevailing at the pump inlet 21.

The axial surface of the balance drum 7 facing the front side is exposed to a pressure which essentially equals the high pressure at the pump outlet 22. At the back side of the balance drum 7 it is essentially the low pressure that prevails during operation of the pump 1. Thus, the pressure drop over the balance drum 7 is essentially the difference between the high pressure and the low pressure.

The pressure drop over the balance drum 7 results in a force that is directed upwardly in the axial direction A and therewith counteracts the downwardly directed axial thrust generated by the impellers 31.

The multiphase pump 1 further comprises a plurality of bearings. A first radial bearing 53, a second radial bearing 54 and an axial bearing 55 are provided for supporting the pump shaft 5. The first radial bearing 53, which is the upper one in FIG. 1, is arranged adjacent to the drive end 51 of the pump shaft 5 between the balance drum 7 and the drive unit 4. The second radial bearing 54, which is the lower one in FIG. 1, is arranged between the impeller 31 of the first stage and the non-drive end 52 of the pump shaft 5 or at the non-drive end 52. The axial bearing 55 is arranged between the impeller 31 of the last stage and the first radial bearing 53. The bearings 53, 54, 55 are configured to support the pump shaft 5 both in axial and radial direction. The radial bearing 53 and 54 are supporting the pump shaft 5 with respect to the radial direction, and the axial bearing 55 is supporting the pump shaft 5 with respect to the axial direction A. The first radial bearing 53 and the axial bearing 55 are arranged such that the first radial bearing 53 is closer to the drive unit 4 and the axial bearing 55 is facing the balance drum 7. Of course, it is also possible, to exchange the position of the first radial bearing 53 and the axial bearing 55, i.e. to arrange the first radial bearing 53 between the axial pump bearing 55 and the balance drum, so that the axial bearing 55 is closer to the drive unit 4.

This configuration with a radial bearing 53 at the drive end 51 of the shaft 5 and a radial bearing 54 at the non-drive end 52 of the pump shaft is called a between bearing arrangement, because all impellers 31 are arranged between the two radial bearings 53, 54.

It has to be noted that in other embodiments the multiphase pump 1 can be configured with only one radial bearing, for example in an overhung configuration.

A radial bearing, such as the first or the second radial bearing 53 or 54 is also referred to as a "journal bearing" and an axial bearing, such as the axial bearing 55, is also referred to as an "thrust bearing". The first radial bearing 53 and the axial bearing 55 can be configured as separate bearings, but it is also possible that the first radial bearing 53 and the axial bearing 55 are configured as a single combined radial and axial bearing supporting the pump shaft 5 both in radial and in axial direction.

The second radial bearing 54 supports the pump shaft 5 in radial direction. In the embodiment shown in FIG. 1, there is no axial bearing provided at the non-drive end 52 of the pump shaft 5. Of course, in other embodiments it is also possible that an axial bearing for the pump shaft 5 is disposed at the non-drive end 52. In embodiments, where an axial bearing is disposed at the non-drive end 52 of the pump shaft 5, a second axial bearing can be disposed at the drive end 51 or the drive end 51 can be configured without an axial bearing.

Preferably, at least the radial bearings 53 and 54 are configured as hydrodynamic bearings, and even more preferred as tilting pad bearings 53, 54. In addition, also the axial bearing 55 can be configured as a hydrodynamic bearing 55, and even more preferred as a tilting pad bearing 55. Of course, it is also possible that the first radial bearing 53 and the second radial bearing 54 are each configured as a fixed multilobe hydrodynamic bearing.

The drive unit 4 comprises an electric motor 41 and a drive shaft 42 extending in the axial direction A. For supporting the drive shaft 42, a first radial drive bearing 43, a second radial drive bearing 44 and an axial drive bearing 45 are provided, wherein the second radial drive bearing 44 and the axial drive bearing 45 are arranged above the electric motor 41 with respect to the axial direction A, and the first radial drive bearing 43 is arranged below the electric motor 41. The electric motor 41, which is arranged between the first and the second radial drive bearing 43, 44, is configured for rotating the drive shaft 42 about the axial direction A. The drive shaft 42 is connected to the drive end 51 of the pump shaft 5 by a coupling 8 for transferring a torque to the pump shaft 5.

The electric motor 41 of the drive unit 4 can be configured as a cable wound motor. In a cable wound motor the individual wires of the motor stator, which form the coils for generating the electromagnetic field(s) for driving the motor rotor, are each insulated, so that the motor stator can be flooded for example with a barrier fluid. Alternatively, the electric motor 41 can be configured as a canned motor. When the electric drive 41 is configured as a canned motor, the annular gap between the motor rotor and the motor stator of the electric motor 41 is radially outwardly delimited by a can that seals the motor stator hermetically with respect to the motor rotor and the annular gap. Thus, any fluid flowing through the gap between the motor rotor and the motor stator cannot enter the motor stator. When the electric motor 41 is designed as a canned motor a dielectric cooling fluid can be circulated through the hermetically sealed motor stator for cooling the motor stator.

Preferably, the electric motor 41 is configured as a permanent magnet motor or as an induction motor. To supply the electric motor 41 with energy, a power penetrator (not shown) is provided at the pump housing 2 for receiving a power cable that supplies the electric motor 41 with power.

The electric motor 41 can be designed to operate with a variable frequency drive (VFD), in which the speed of the motor 41, i.e. the frequency of the rotation, is adjustable by varying the frequency and/or the voltage supplied to the electric motor 41. However, it is also possible that the electric motor 41 is configured differently, for example as a single speed or single frequency drive.

The drive shaft 42 is connected to the drive end 51 of the pump shaft 5 by the coupling 8 for transferring a torque to the pump shaft 5. Preferably the coupling 8 is configured as a flexible coupling 8, which connects the drive shaft 42 to the pump shaft 5 in a torque proof manner but allows for a relative lateral (radial) and/or axial movement between the drive shaft 42 and the pump shaft 5. Thus, the flexible coupling 8 transfers the torque but no or nearly no lateral vibrations. Preferably, the flexible coupling 8 is configured as a mechanical coupling 8. In other embodiments the flexible coupling can be designed as a magnetic coupling, a hydrodynamic coupling or any other coupling that is suited to transfer a torque from the drive shaft 42 to the pump shaft 5.

As already said, in other embodiments the drive unit 4 can be disposed in a separate motor housing, which is for example arranged outside of the pump housing 2.

The multiphase pump 1 further comprises two sealing units 50 for sealing the pump shaft 5 against a leakage of the process fluid along the pump shaft 5. By the sealing units 50 the process fluid is prevented from entering the drive unit 4 as well as the bearings 53, 54, 55. One of the sealing units 50 is arranged between the balance drum 7 and the axial bearing 55 and the other sealing unit 50 is arranged between the impeller 31 of the first stage and the second radial bearing 54. Preferably each sealing unit 50 comprises a mechanical seal. Mechanical seals are well-known in the art in many different embodiments and therefore require no detailed explanation. In principle, a mechanical seal is a seal for a rotating shaft and comprises a rotor fixed to the pump shaft 5 and rotating with the pump shaft 5, as well as a stationary stator fixed with respect to the pump housing 2. During operation the rotor and the stator are sliding along each other—usually with a liquid there between—for providing a sealing action to prevent the process fluid from escaping to the environment or entering the drive unit 4 of the pump 1.

In other embodiments the multiphase pump 1 can be configured as a sealless pump, e.g. without any mechanical seal.

The arrangement of the at least one swirl brake 6 will now be explained in more detail by several embodiments and variants. In this explanation only the configuration of the ring 30 as well as the arrangement of the swirl brake(s) 6 will be discussed in more detail. The preceding description of the first embodiment of the multiphase pump 1 applies for all these embodiments and variants in the same manner or in an analogously manner.

Figure 4:
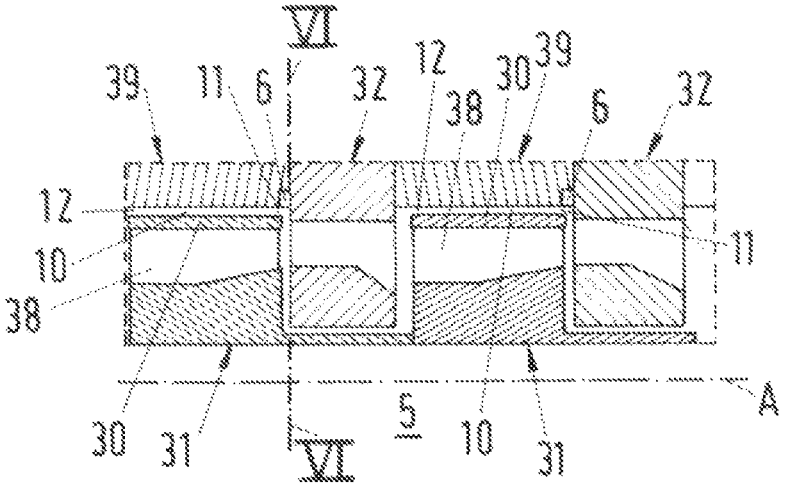
FIG. 4 is a schematic representation of the impellers and the diffusors of the first embodiment.

FIG. 4 shows two impellers 31 and two diffusers 32 of the first embodiment in a schematic cross-sectional view with the cut line extending in the axial direction A and through the pump shaft 5. In this embodiment there is only one swirl brake 6 per stage, which is arranged in the stationary part 39 surrounding the impeller 31. With respect to the axial direction A the swirl brake 6 is arranged at the entrance 11 of the passage 10. It is possible that the swirl brake 6 is arranged to be aligned with the axial end of the ring 30 delimiting the entrance 11 or the swirl brake 6 is arranged adjacent to said axial end of the ring 30.

Figure 6:
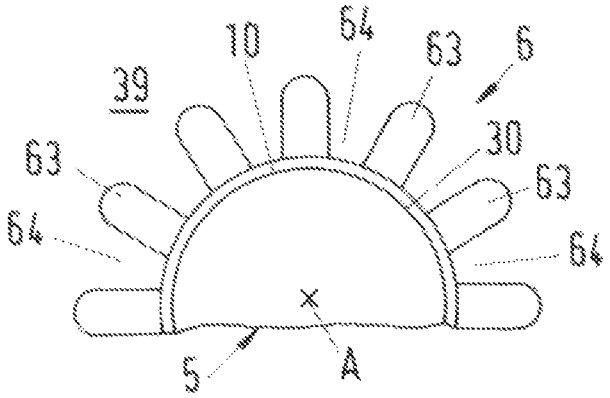
FIG. 6 is the embodiment shown in FIG. 4 in a cross-sectional view perpendicular to the pump shaft along cutting line VI-VI in FIG. 4.

The swirl brake can be designed for example in any manner which is as such known in the art. FIG. 6 shows an example for the design of the swirl brake 6 in FIG. 4 in a cross-sectional view perpendicular to the pump shaft 5 along the cutting line VI-VI in FIG. 4. The swirl brake 7 comprises a plurality of notches 63 disposed at the radially inner surfaces of the stationary part 39. Each notch 63 extends in the radial direction. The notch 63 are distributed, preferably equidistantly, on a circle along the entire radially inner surface of the stationary part 39. Thus, between two adjacent notches 63 there is in each case a bar 64, also extending in the radial direction. The notches 63 and the bars 64 can be produced for example by drilling holes into the radially inner surfaces of the stationary part 39 or by providing the axial end of the stationary part 39 with the notches 63. The geometry of the notches 63 and bars 64 shown in FIG. 6 is of course exemplary only. It is also possible that the bars 64 have, for example, the shape of a cuboid or a cube. For manufacturing the swirl brake 6 with the notches 63 and the bars 64 all appropriate methods can be used, for example machining.

Figure 5:
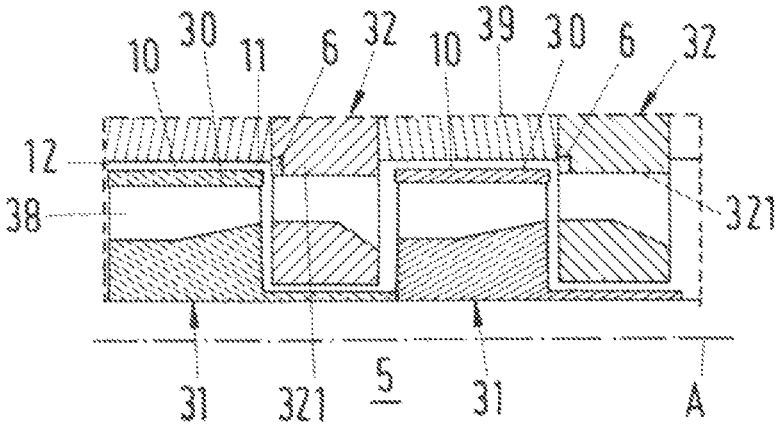
FIG. 5 is as FIG. 4, but for a variant of the first embodiment.

FIG. 5 shows a variant of the first embodiment in an analogous representation as FIG. 4. According to this variant, the swirl brake 6 is arranged at the diffuser 32. More particular, the swirl brake 6 is arranged at the axial end of a diffuser shroud 321 forming the radially outer surface of the diffuser 32. The swirl brake 6 is disposed in that axial end of the diffuser shroud 321, which is located at the entrance 11 of the passage 10.

Figure 7:
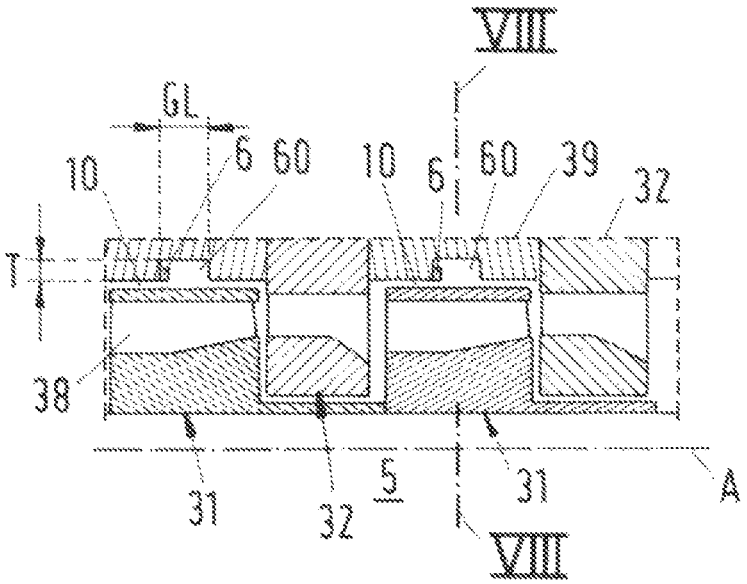
FIG. 7 is as FIG. 4, but for a second embodiment of a multiphase pump according to the invention.

FIG. 7 shows in an analogous representation as FIG. 4 a second embodiment. The second embodiment also comprises only one swirl brake 6. The swirl brake 6 is arranged in a groove 60, which is disposed in the radially inner surface of the stationary part 39. The groove 60 is configured as an annular groove 60 that completely surrounds the pump shaft 5 in the circumferential direction. The groove 60 has a depth T which is the extension of the groove 60 in the radial direction. The groove 60 has a width GL which is the extension of the groove 60 in the axial direction A. The notches 63 and bars 64 of the swirl brake 6 are arranged inside the groove 60, in particular at a wall of the groove 60 which delimits the groove 60 with respect to the axial direction A. The bars 64 are arranged such that they are flush with the radially inner surface of the stationary part 39. Regarding the extension in the radial direction the bars 64 are shorter than the depth T of the groove 60, so that the bars 64 do not extend to the bottom of the groove 60. Regarding the extension in the axial direction the bars 64 are shorter than the width GL of the groove 60, so that the bars 64 do not extend to the other wall of the groove 60 which delimits the groove 60 with respect to the axial direction A.

In other embodiments the extension of the bars 64 in the radial direction equals the depth T of the groove 60, so that the bars 64 extend to the bottom of the groove 60.

Figure 8:
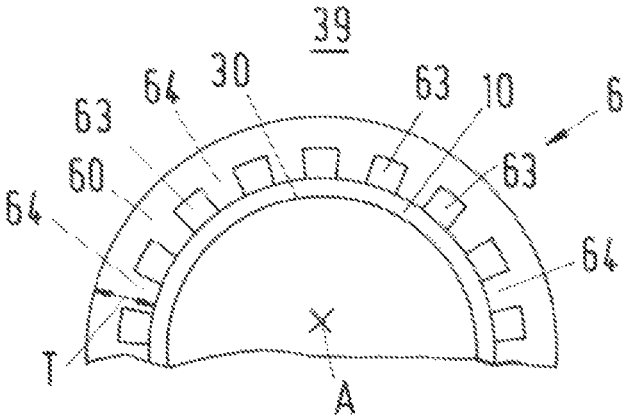
FIG. 8 is the second embodiment shown in FIG. 7 in a cross-sectional view perpendicular to the pump shaft along cutting line VIII-VIII in FIG. 7.

For a better understanding FIG. 8 shows a cross-sectional view perpendicular to the pump shaft 5 along the cutting line VIII-VIII in FIG. 7. As can be best seen in FIG. 8 the bars 64 have the shape of a cuboid, in particular of a cube. This shape is exemplary only. In other embodiments the bars can have different shapes, for example a tapering shape such as a trapezoidal shape.

Referring now to FIG. 9-FIG. 12 further embodiments will be described, which comprise more than one swirl brake 6. It has to be noted that the explanations regarding the embodiments with only one swirl brake 6 also apply to the embodiments having more than one swirl brake in an analogous manner.

Figure 9:
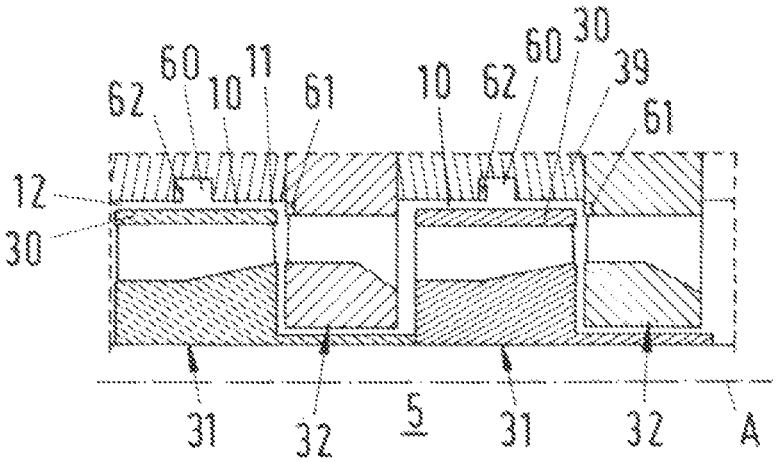
FIG. 9 is as FIG. 4, but for a third embodiment of a multiphase pump according to the invention.

FIG. 9 shows in an analogous representation as FIG. 4 a third embodiment. The third embodiment comprises a plurality of swirl brakes per stage, here two swirl brakes, namely a first swirl brake 61 arranged at the entrance 11 of the passage 10, and a second swirl brake 62, which is arranged in a groove 60 surrounding the pump shaft 5 in a circumferential direction, wherein the groove 60 is disposed in the radially inner surface of the stationary part 39 between the entrance 11 and the discharge 12 of the passage 10.

The first swirl brake 61 is arranged at the diffuser 32. More particular, the first swirl brake 61 is arranged at the axial end of the diffuser shroud 321 forming the radially outer surface of the diffuser 32. The first swirl brake 61 is disposed in that axial end of the diffuser shroud 321 which is located at the entrance 11 of the passage 10.

The second swirl brake 62 is arranged in the groove 60 in an analogous manner as it has been explained with respect to FIG. 7

Figure 10:
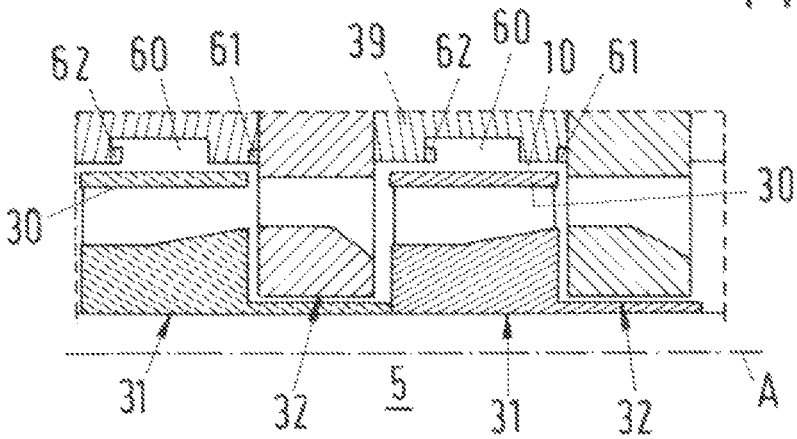
FIG. 10 is as FIG. 9, but for a first variant of the third embodiment.

FIG. 10 shows a first variant of the third embodiment in an analogous representation as FIG. 9. According to this variant, the first swirl brake 61 is arranged in the stationary part 39 in an analogous manner as it has been described with respect to FIG. 4.

Figure 11:
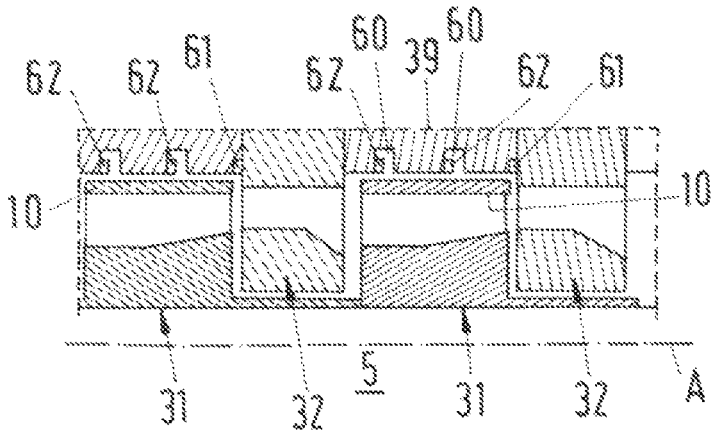
FIG. 11 is as FIG. 9, but for a second variant of the third embodiment.

FIG. 11 shows a second variant of the third embodiment in an analogous representation as FIG. 9. According to this variant, two second swirl brakes 62 are provided per stage, each of which is arranged in a different groove 60. Thus, there are provided two grooves 60 spaced apart from each other with respect to the axial direction A, wherein each groove 60 is arranged in the radially inner surface of the stationary part 39 between the entrance 11 and the discharge 12 of the passage 10. In each of the grooves 60 one of the second swirl brakes 62 is provided, each of which can be designed as it has been explained with respect to FIG. 7. In other embodiments (e.g. FIG. 14) more than two second swirl brakes 62 can be provided.

Figure 12:
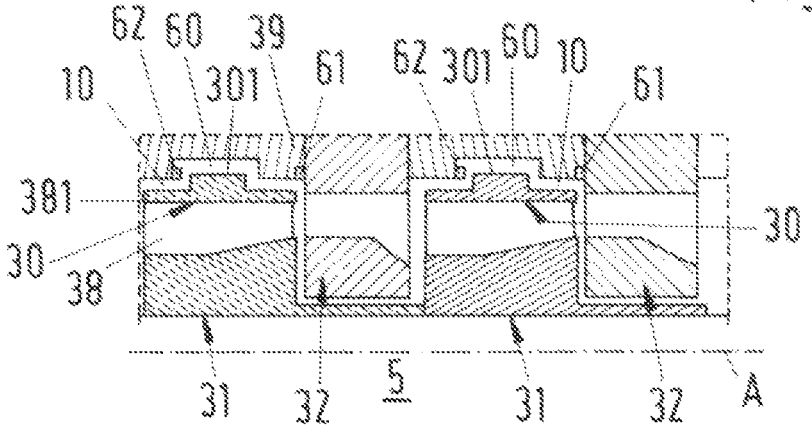
FIG. 12 is as FIG. 4, but for a fourth embodiment of a multiphase pump according to the invention.

FIG. 12 shows in an analogous representation as FIG. 4 a fourth embodiment. Regarding the swirl brakes 61, 62 the fourth embodiment is similar to the first variant of the third embodiment, which is shown in FIG. 10. The fourth embodiment also comprises the first swirl brake 61 arranged in the stationary part 39 at the entrance 11 of the passage 10, and the second swirl brake 62, which is arranged in the groove 60 surrounding the pump shaft 5 in a circumferential direction, wherein the groove 60 is disposed in the radially inner surface of the stationary part 39 between the entrance 11 and the discharge 12 of the passage 10.

In the fourth embodiment the ring 30 surrounding the impeller at the radially outer tips 381 of the blades 38 comprises a protrusion 301 extending along the circumference of the ring 30, wherein the protrusion 301 is configured to deflect the process fluid at least partially into the groove 60 where the second swirl brake 62 is arranged. By deflecting at least a part of the process fluid from the passage 10 into the groove 60 where the second swirl brake 62 is arranged the reduction of the swirl in the passage 10 or the reduction of the swirl build-up can even be increased.

In an axial cross-sectional view as it is shown in FIG. 12 the protrusion 301 can have a quadrangular cross section. In other embodiments the protrusion can have other cross sections, for example a rounded cross section or a trapezoidal cross section or a square cross section.

As a further advantageous measurement the protrusion 301 is aligned with the groove 60 with respect to the axial direction A as it is shown in FIG. 12. Preferably, the groove 60 completely covers the protrusion 301 as viewed in the radial direction. To this end the width GL of the groove 60 (see FIG. 7) is at least as large and preferably larger than the extension of the protrusion 301 in the axial direction A. Furthermore, it is preferred that the protrusion 301 has an extension in the radial direction, which is as large that the protrusion 301 extends into the groove 60.

In still other embodiments a plurality of grooves 60 with second swirl brakes 62 is provided, similar as it is shown in FIG. 11. In such embodiments it is possible that for more than one of the grooves 60 a protrusion 301 at the ring 30 is provided in an analogous manner as explained with reference to FIG. 12. It is also possible that for each groove 60 a particular protrusion 301 is disposed at the ring 30.

Figure 13:
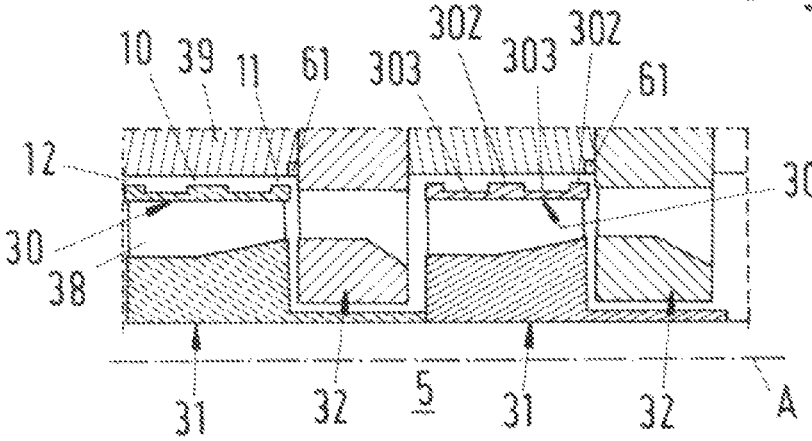
FIGS. 13-15 are as FIG. 4, but illustrating further measures, which are applicable to all embodiments.
Figure 14:
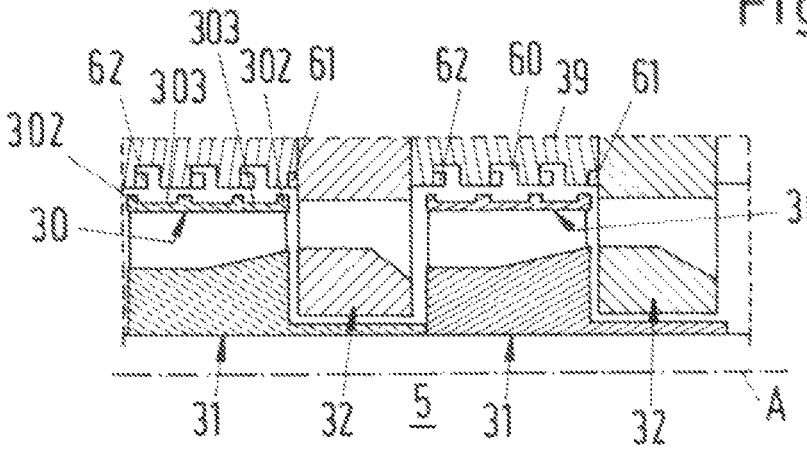
Figure 15:
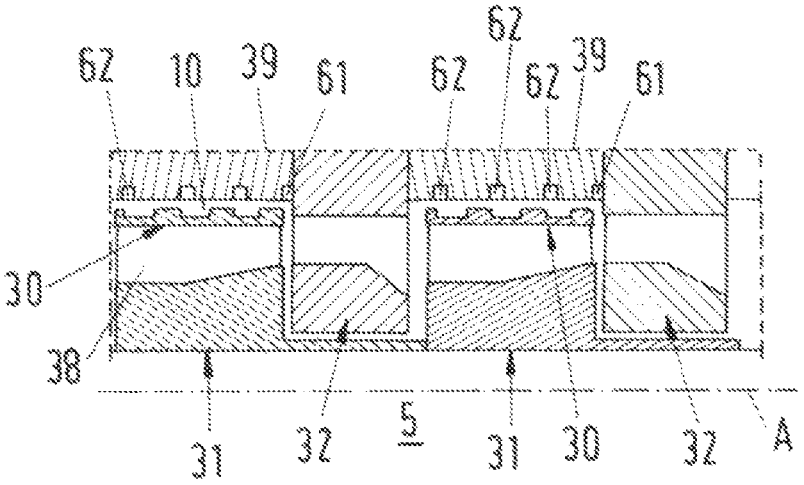

Referring now to FIG. 13-FIG. 15 further advantageous measures are explained which are applicable to all the embodiments and variants explained hereinbefore. Each of FIG. 13-FIG. 15 shows a representation which is analogous to the representation in FIG. 4.

As shown in FIG. 13 there is only provided the first swirl brake 61 which is arranged in the stationary part 39 at the inlet 11 to the passage 10. The ring 30 covering the impeller 31 at the radially outer ends 381 of the blades 38 is configured as a labyrinth seal with lands 302 and channels 303. As it is known from labyrinth seal designs, each land 302 is designed as a annular ring extending in the circumferential direction around the ring 30 on the radially outer surface and protruding in the radial direction, so that between each pair of adjacent lands 302 a channel 303 is formed. By this labyrinth design of the ring 30 the passage 10 is divided into tight seal areas formed between each of the lands 302 and the stationary part 39 and broader areas between each channel 303 and the stationary part 39. By this measure the overall tight length of the passage 10, which is the sum of the extensions of all tight areas in the axial direction A can be reduced, so that the drag in the passage 10 is considerably reduced. Reducing the drag in the passage 10 increases the efficiency of the pump 1, in particular the hydraulic efficiency.

FIG. 14 shows a design with the first swirl brake 61 which is arranged in the stationary part 39 at the inlet 11 to the passage 10, and with three second swirl brakes 62, each of which is arranged in a different one of the three grooves 60. The ring 30 is designed as a labyrinth seal with the lands 302 and the channels 303 arranged on the radially outer surface of the ring 30. As compared to FIG. 13 the extension of the lands 302 in the axial direction A is considerably smaller than the extension of the channel 303 in the axial direction. Thus, the overall tight length of the passage 10, which is the sum of the extensions of all tight areas in the axial direction A is further reduced resulting in an even lower drag in the passage 10.

According to the measure illustrated in FIG. 15 the second swirl brakes 62, here three second swirl brakes 62 per stage, are not arranged in grooves 60 but disposed in the radially inner surface of the stationary part 39 without any grooves. The second swirl brakes 62 can be manufactured for example by machining.

Figure 16:
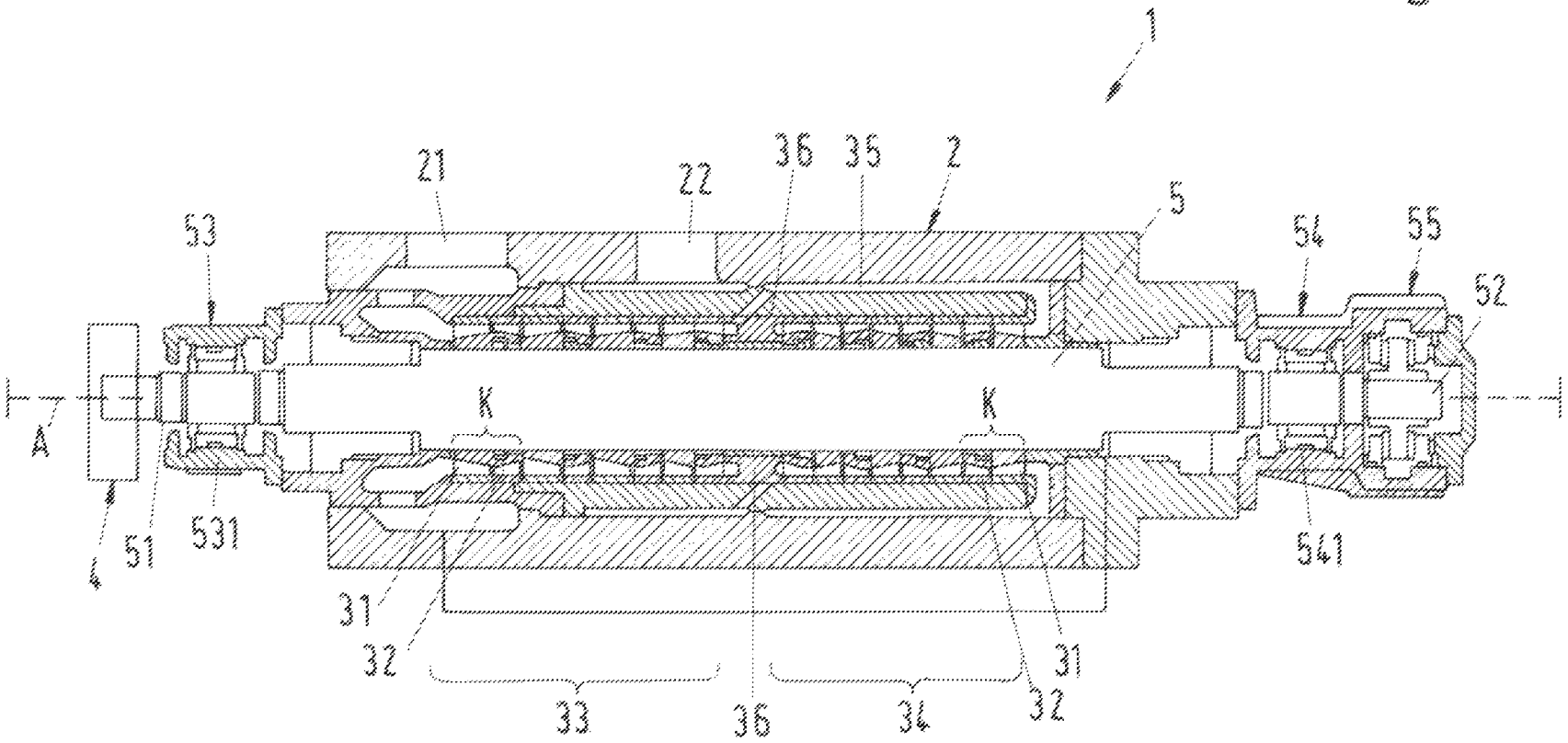
FIG. 16 is a cross-sectional view of a configuration of a multiphase pump according to the invention, having a back-to-back design.

FIG. 16 shows a cross-sectional view of a configuration of a multiphase pump 1 according to the invention having a back-to-back design. In the following description of the back-to back configuration only the differences in particular to the first embodiment of the multiphase pump 1 are explained in more detail. The explanations with respect to the first embodiment of the multiphase pump 1 as well as the explanations with reference to FIG. 2-FIG. 15 are also valid in the same way or in analogously the same way for the back-to-back design of the multiphase pump 1. Same reference numerals designate the same features that have been explained with reference to the first embodiment or functionally equivalent features.

It has to be noted that in FIG. 16 the passage 10 between the rings 30 and the stationary parts 39 as well as the swirl brakes 6 and/or the first swirl brakes 61 and/or the second swirl brakes 62 are not noticeable due to the larger scale, however these components 10, 30, 39, 6, 61, 62 can be configured in any matter described hereinbefore.

The multiphase pump 1 with the back-to-back design is also configured as a helico-axial multistage pump 1 with a plurality of helico-axial impellers 31 (see also FIG. 2 and FIG. 3). Furthermore, the multiphase pump 1 is configured as a horizontal pump 1, meaning that during operation the pump shaft 5 is extending horizontally, i.e. the axial direction A is perpendicular to the direction of gravity. The drive unit 4 is not arranged within the pump housing 2 but in a separate motor housing which is not shown in detail.

The first radial bearing 53 at the drive end 51 of the pump shaft 5 is arranged in a first bearing housing 531, which is fixedly mounted to the pump housing 2 and therefore can also be considered as a part of the pump housing 2. The second radial bearing 54 at the non-drive end 52 of the pump shaft 5 is arranged in a second bearing housing 541, which is fixedly mounted to the pump housing 2 and therefore can also be considered as a part of the pump housing 2. The axial bearing 55 is arranged at the non-drive end 52 of the pump shaft 2 and can be arranged within the second bearing housing 541.

The multistage stage, multiphase pump 1 shown in FIG. 16 is configured with eight stages wherein each stage comprises one impeller 31 and one diffusor 32 as it is indicated by the reference numeral K in FIG. 16.

As can be seen in FIG. 16 the plurality of impellers 31 comprises a first set of impellers 33 and a second set of impellers 34, wherein the first set of impellers 33 and the second set of impellers 34 are arranged in a back-to-back arrangement. The first set of impellers 33 comprises the impeller 31 of the first stage, which is the stage next to the pump inlet 2, and the impellers 31 of the stages two, three and four. The second set of impellers 34 comprises the impeller 31 of the last stage, which is the stage next to the pump outlet 22, and the impellers 31 of the stages five, six and seven.

In other embodiments the first set of impellers can comprise a different number of impellers than the second set of impellers. The number of eight stages is of course exemplary. In other embodiments there can be more or less than eight stages.

In a back-to-back arrangement the first set of impellers 33 and the second set of impellers 34 are arranged such that the axial thrust generated by the action of the rotating first set of impellers 33 is directed in the opposite direction as the axial thrust generated by the action of the rotating second set of impellers 34. The multiphase process fluid enters the multistage pump 1 through the pump inlet 21 located at the left side according to the representation in FIG. 16, passes the stages one (first stage), two, three and four, is then guided through a crossover line 35 to the suction side of the fifth stage impeller, which is the rightmost impeller 31 in FIG. 16 passes the stages five, six, seven and eight (last stage), and is then discharged through the pump outlet 22. Thus, the flow of the multiphase process fluid through the first set of impellers 33 is directed essentially in the opposite direction than the flow through the second set of impellers 34.

For many applications the back-to-back arrangement is preferred because the axial thrust acting on the pump shaft 5, which is generated by the first set of impellers 33 counteracts the axial thrust, which is generated by the second set of impellers 34. Thus, said two axial thrusts compensate each other at least partially.

As a further balancing device for reducing the overall axial thrust acting on the pump shaft 5, a center bush 36 is arranged between the first set of impellers 33 and the second set of impellers 34. The center bush 35 is fixedly connected to the pump shaft 5 in a torque proof manner and rotates with the pump shaft 5. The center bush 35 is arranged on the pump shaft 5 between the last stage impeller 31, which is the last impeller of the second set of impellers 34, and the impeller 31 of the fourth stage, which is the last impeller 31 of the first set of impellers 33, when viewed in the direction of increasing pressure, respectively. The center bush 35 is surrounded by a stationary throttle part being stationary with respect to the pump housing 2. An annular balancing passage is formed between the outer surface of the center bush 35 and the stationary throttle part.

The function of the center bush 35 between the first and the second set of impellers 33, 34 is a balancing of the axial thrust and a damping of the pump shaft 5 based on the Lomakin effect. At the axial surface of the center bush 35 facing the impeller 31 of the last stage the high pressure prevails, and at the other axial surface facing the impeller 31 of the fourth stage a lower pressure prevails, which is an intermediate pressure between the high pressure and the low pressure. Therefore, the process fluid can pass from the impeller 31 of the last stage through the balancing passage along the center bush 36 to the impeller 31 of the fourth stage.

The pressure drop over the center bush 36 essentially equals the difference between the high pressure and the intermediate pressure. Said pressure drop over the center bush 36 results in a force that is directed to the left according to the representation in FIG. 16 and therewith counteracts the axial thrust generated by the second set of impellers 34, which is directed to the right according to the representation in FIG. 16.

As a further balancing device for reducing the overall axial thrust acting on the pump shaft 5 the multiphase pump 1 can also comprise the balance drum 7 with the balance line 9 in an analogous manner as it has been described with respect to the first embodiment of the multistage pump 1.

Of course, it is also possible that the back-to-back design is used for embodiments configured as a vertical multiphase pump 1 with the pump shaft 5 extending in the direction of gravity and/or for embodiments, where the drive unit 4 is arranged within the pump housing 2.

What is claimed:

1. A multiphase pump for conveying a multiphase process fluid, comprising:

a pump housing;

a rotor arranged in the pump housing and configured to rotate about an axial direction, the rotor comprising a pump shaft and an impeller fixedly mounted on the pump shaft;

a stationary diffuser is arranged adjacent to and downstream of the impeller, the impeller comprising a blade with the blade having a radially outer tip, and the impeller comprising a ring surrounding the impeller and arranged at the radially outer tip of the blade, a passage is disposed between the ring and a stationary part configured to be stationary with respect to the pump housing, the passage extending in the axial direction from an entrance to a discharge; and a swirl brake disposed at the passage, the swirl brake configured and arranged to brake a swirl of the process fluid passing through the passage;

the ring defining an innermost diameter and the blade defining an outer diameter and the innermost diameter of the ring being greater than the outer diameter of the blade.

2. The multiphase pump in accordance with claim 1, wherein the swirl brake is arranged at an entrance of the passage.

3. The multiphase pump in accordance with claim 1, wherein the swirl brake is arranged at the stationary diffuser.

4. The multiphase pump in accordance with claim 1, wherein the swirl brake is arranged at the stationary part.

5. The multiphase pump in accordance with claim 1, wherein the stationary part comprises a radially inner surface delimiting the passage with respect to a radial direction perpendicular to the axial direction, the radially inner surface including a groove surrounding the pump shaft in a circumferential direction, and the swirl brake is arranged in the groove.

6. The multiphase pump in accordance with claim 1, wherein the swirl brake is a first swirl brake of a plurality of swirl brakes, the first swirl brake arranged at an entrance of the passage, and a second swirl brake of the plurality of swirl brakes is arranged in a groove surrounding the pump shaft in a circumferential direction, the groove being disposed in a radially inner surface of the stationary part, delimiting the passage with respect to a radial direction perpendicular to the axial direction.

7. The multiphase pump in accordance with claim 6, wherein the first swirl brake is arranged at the diffusor or at the stationary part.

8. The multiphase pump in accordance with claim 6, wherein the second swirl brake is one of a plurality of second swirl brakes, each of the plurality of second swirl brakes being arranged in a different groove.

9. The multiphase pump in accordance with claim 5, wherein the ring surrounding the impeller comprises a protrusion extending along a circumference of the ring, and the protrusion is configured to deflect the process fluid at least partially into the swirl brake in the groove.

10. The multiphase pump in accordance with claim 9, wherein the protrusion is aligned with the groove with respect to the axial direction.

11. The multiphase pump in accordance with claim 1, wherein the ring is configured to form a labyrinth seal between the impeller and the stationary part.

12. The multiphase pump in accordance with claim 1, further comprising a first stage and a second stage, and the impeller and stationary diffuser are a first impeller and a first diffuser in the first stage and the second stage includes a second impeller and a second diffuser, the first impeller includes the ring surrounding the first impeller, and the swirl brake is provided at the passage, delimited by the ring.

13. The multiphase pump in accordance with claim 1 wherein the multiphase pump is a helico-axial pump and the impeller is an helico-axial impeller.

14. The multiphase pump in accordance with claim 1, further comprising a drive unit arranged in the pump housing and configured to drive the rotor.

15. The multiphase pump in accordance with claim 1, wherein the multiphase pump is a subsea pump.

16. The multiphase pump in accordance with claim 14, wherein the multiphase pump is a vertical pump with the pump shaft extending in a direction of gravity.

17. The multiphase pump in accordance with claim 1, wherein the multiphase pump is a subsea pump and configured for installation on a sea ground.

18. The multiphase pump in accordance with claim 1, wherein the ring surrounds the impeller in a radial direction.

19. A multiphase pump for conveying a multiphase process fluid, comprising:

a pump housing;

a rotor arranged in the pump housing and configured to rotate about an axial direction, the rotor comprising a pump shaft and an impeller fixedly mounted on the pump shaft;

a stationary diffuser is arranged adjacent to and downstream of the impeller, the impeller comprising a blade with the blade having a radially outer tip, and the impeller comprising a ring surrounding the impeller and arranged at the radially outer tip of the blade, a passage is disposed between the ring and a stationary part configured to be stationary with respect to the pump housing, the passage extending in the axial direction from an entrance to a discharge; and a swirl brake disposed at the passage, the swirl brake configured and arranged to brake a swirl of the process fluid passing through the passage, an inner surface of the ring being parallel to the axial direction.

20. A multiphase pump for conveying a multiphase process fluid, comprising:

a pump housing;

a rotor arranged in the pump housing and configured to rotate about an axial direction, the rotor comprising a pump shaft and an impeller fixedly mounted on the pump shaft;

a stationary diffuser is arranged adjacent to and downstream of the impeller, the impeller comprising a blade with the blade having a radially outer tip, and the impeller comprising a ring surrounding the impeller and arranged at the radially outer tip of the blade, a passage is disposed between the ring and a stationary part configured to be stationary with respect to the pump housing, the passage extending in the axial direction from an entrance to a discharge; and a swirl brake disposed at the passage, the swirl brake configured and arranged to brake a swirl of the process fluid passing through the passage, the ring surrounding the impeller such that an axial length of the ring is approximately equal to an extension length of the blade of the impeller.

* * * * *